US007374060B2

(12) United States Patent
Yang et al.

(10) Patent No.: US 7,374,060 B2
(45) Date of Patent: May 20, 2008

(54) TRASH CAN ASSEMBLY

(75) Inventors: Frank Yang, Palos Verdes Peninsula, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 0 days.

(21) Appl. No.: 10/609,076

(22) Filed: Jun. 27, 2003

(65) Prior Publication Data

US 2004/0004080 A1 Jan. 8, 2004

Related U.S. Application Data

(63) Continuation-in-part of application No. 10/131,430, filed on Apr. 24, 2002.

(51) Int. Cl.

| | |
|---|---|
| ***B65D 43/14*** | (2006.01) |
| ***B65D 43/26*** | (2006.01) |
| ***B65D 51/04*** | (2006.01) |
| *B65D 25/16* | (2006.01) |
| *B65D 90/04* | (2006.01) |

(52) U.S. Cl. ..... 220/263; 220/264; 220/826; 220/844; 220/908

(58) Field of Classification Search ..... 220/495.06–495.11, 244, 262–264, 843, 220/844, 848, 908, 908.1, 90, 23.9, 23.91, 220/527, 528, 826, 840, 841, 213, 254.2, 220/254.3

See application file for complete search history.

(56) References Cited

U.S. PATENT DOCUMENTS

| | | | | |
|---|---|---|---|---|
| 1,503,015 | A * | 7/1924 | Barnstead | 220/264 |
| 1,820,555 | A | 8/1931 | Buschman | |
| 1,891,651 | A | 12/1932 | Padelford et al. | |
| 1,893,743 | A * | 1/1933 | Hirshman | 220/671 |
| 2,549,572 | A * | 4/1951 | Campanelli | 220/212 |
| 2,759,625 | A | 8/1956 | Ritter | |
| 2,946,474 | A | 7/1960 | Knapp | |

(Continued)

FOREIGN PATENT DOCUMENTS

| | | |
|---|---|---|
| DE | 19933180 | 1/2001 |

(Continued)

OTHER PUBLICATIONS

Trento Corner 23.

*Primary Examiner*—Anthony Stashick
*Assistant Examiner*—Niki M. Eloshway
(74) *Attorney, Agent, or Firm*—Raymond Sun

(57) ABSTRACT

A trash can assembly has a shell, a lid fitted over the top end of the shell, a pedal positioned adjacent the bottom end of the shell, a link assembly coupling the pedal and the lid, and a motion damper coupled to the link assembly for slowing the closing motion of the lid. The assembly also includes an inner liner that is retained inside the shell, with a support frame secured to the top end of the shell and having a ridge on which a peripheral lip of the inner liner rests. Two or more inner liners can be provided inside the shell. In addition, the lid can be pivotably connected to the upper edge of the outer shell by a connector which has a sleeve that is coupled to the upper edge of the outer shell, a non-metal tube that is positioned inside the sleeve, and a shaft received inside the bore of the tube.

12 Claims, 12 Drawing Sheets

U.S. PATENT DOCUMENTS 3,008,604 A 11/1961 Garner
3,654,534 A 4/1972 Fischer
3,891,115 A 6/1975 Ono
4,014,457 A * 3/1977 Hodge ..... 220/812
4,081,105 A 3/1978 Dagonnet et al.
4,200,197 A 4/1980 Meyer et al.
4,558,799 A * 12/1985 Hammond ..... 220/826
4,630,332 A * 12/1986 Bisbing ..... 16/273
4,663,803 A * 5/1987 Gora ..... 16/266
4,765,548 A 8/1988 Sing
4,792,039 A * 12/1988 Dayton ..... 206/304
4,913,308 A 4/1990 Culbertson
4,918,568 A 4/1990 Stone et al.
5,065,272 A 11/1991 Owen et al.
5,111,958 A * 5/1992 Witthoeft ..... 220/524
5,147,055 A * 9/1992 Samson et al. ..... 220/259.2
5,170,904 A * 12/1992 Neuhaus ..... 220/262
5,174,462 A 12/1992 Hames
5,226,558 A 7/1993 Whitney et al.
5,230,525 A 7/1993 Delmerico et al.
5,249,693 A 10/1993 Gillispie et al.
5,322,179 A 6/1994 Ting
5,328,048 A * 7/1994 Stein ..... 220/826
5,348,222 A * 9/1994 Patey ..... 232/43.2
5,385,258 A * 1/1995 Sutherlin ..... 220/324
5,390,818 A 2/1995 LaBuda
5,452,847 A * 9/1995 Harris et al. ..... 229/125.11
5,471,708 A 12/1995 Lynch
5,474,201 A 12/1995 Liu
5,558,254 A * 9/1996 Anderson et al. ..... 220/527
D377,554 S 1/1997 Adriaansen
5,662,235 A * 9/1997 Nieto ..... 220/23.86
5,967,392 A * 10/1999 Niemi et al. ..... 224/404
6,010,024 A 1/2000 Wang
6,024,238 A 2/2000 Jaros
6,036,050 A * 3/2000 Ruane ..... 220/831
D435,951 S 1/2001 Yang et al.
6,209,744 B1 4/2001 Gill
6,250,492 B1 6/2001 Verbeek
6,364,147 B1 4/2002 Meinzinger et al.
6,386,386 B1 * 5/2002 George ..... 220/526
6,390,321 B1 5/2002 Wang
6,401,958 B1 * 6/2002 Foss et al. ..... 220/320
6,626,316 B2 * 9/2003 Yang ..... 220/263
6,626,317 B2 9/2003 Pfiefer et al.
6,851,251 B2 * 2/2005 Stravitz ..... 53/567
7,077,283 B2 * 7/2006 Yang et al. ..... 220/262

FOREIGN PATENT DOCUMENTS

JP 6-272888 9/1994
WO WO 92/02430 2/1992

* cited by examiner

TRASH CAN ASSEMBLY

RELATED CASES

This is a continuation-in-part of Ser. No. 10/131,430, filed Apr. 24, 2002, entitled "Trash Can Assembly", the entire disclosure of which is incorporated by this reference as though set forth fully herein.

BACKGROUND OF THE INVENTION

1. Field of the Invention

The present invention relates to household items, and in particular, to a trash can assembly that incorporates a number of improvements and enhancements.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to deposit trash, or to change the plastic liner or bag that is used to line the trash can. Other trash cans have even provided an interior metal or plastic liner that fits inside the trash can, and which can be removed to be washed. However, these conventional trash cans still suffer from a number of drawbacks.

For example, the foot pedals on some of the conventional trash cans are noisy to use. In particular, stepping on a foot pedal of a conventional trash can often results in a loud banging noise as the lid is opened, and releasing the step on the foot pedal will also result in another loud banging noise as the lid slams shut under the force of gravity. These banging actions also result in wear and tear to the contacting parts.

Other problems are associated with the internal liner. In conventional trash cans that use an internal liner, the user typically needs to remove the internal liner from the trash can to dispose of the contents therein. To do so, the user typically lifts the internal liner from the trash can, and this may result in the user gripping portions of the surfaces of the internal liner (or a trash bag that lines the internal liner), so that the user's fingers may come into contact with dirt, germs or trash items. In many of the conventional trash cans, there are no good ways to grip and hold the internal liner without the user's fingers actually contacting the surface of the trash bag that lines the internal liner, or the surface of the internal liner itself.

Thus, there remains a need for a trash can that overcomes the drawbacks identified above.

SUMMARY OF THE DISCLOSURE

It is an object of the present invention to provide a trash can assembly that reduces noise and wear when the step pedal is actuated to open and close the lid.

It is another object of the present invention to provide a trash can assembly that allows the user to remove an internal liner in a sanitary manner.

It is yet another object of the present invention to reduce the metal-to-metal grinding of moving parts in a trash can assembly so as to improve the durability and performance of the trash can assembly.

It is yet a further object of the present invention to provide a trash can assembly which has a plurality of separate inner liners.

In order to accomplish the objects of the present invention, there is provided a trash can assembly that has a shell having an enclosing wall. The assembly has a lid fitted over the top end of the shell, a pedal positioned adjacent the bottom end of the shell, a link assembly coupling the pedal and the lid, and a motion damper coupled to the link assembly for slowing the closing motion of the lid.

In accordance with another embodiment of the present invention, the assembly can also include an inner liner that is retained inside the shell, the inner liner having a peripheral lip, and a support frame secured to the top end of the shell, the support frame having a ridge on which the lip of the inner liner rests, and with the support frame further including a groove adjacent the inner liner.

In accordance with another embodiment of the present invention, two or more inner liners can be provided inside the shell.

In accordance with another embodiment of the present invention, the lid is pivotably connected to the upper edge of the outer shell by a connector which has a sleeve that is coupled to the upper edge of the outer shell, a non-metal tube that is positioned inside the sleeve, and a shaft received inside the bore of the tube.

DETAILED DESCRIPTION OF THE PREFERRED EMBODIMENTS

Figure 1:
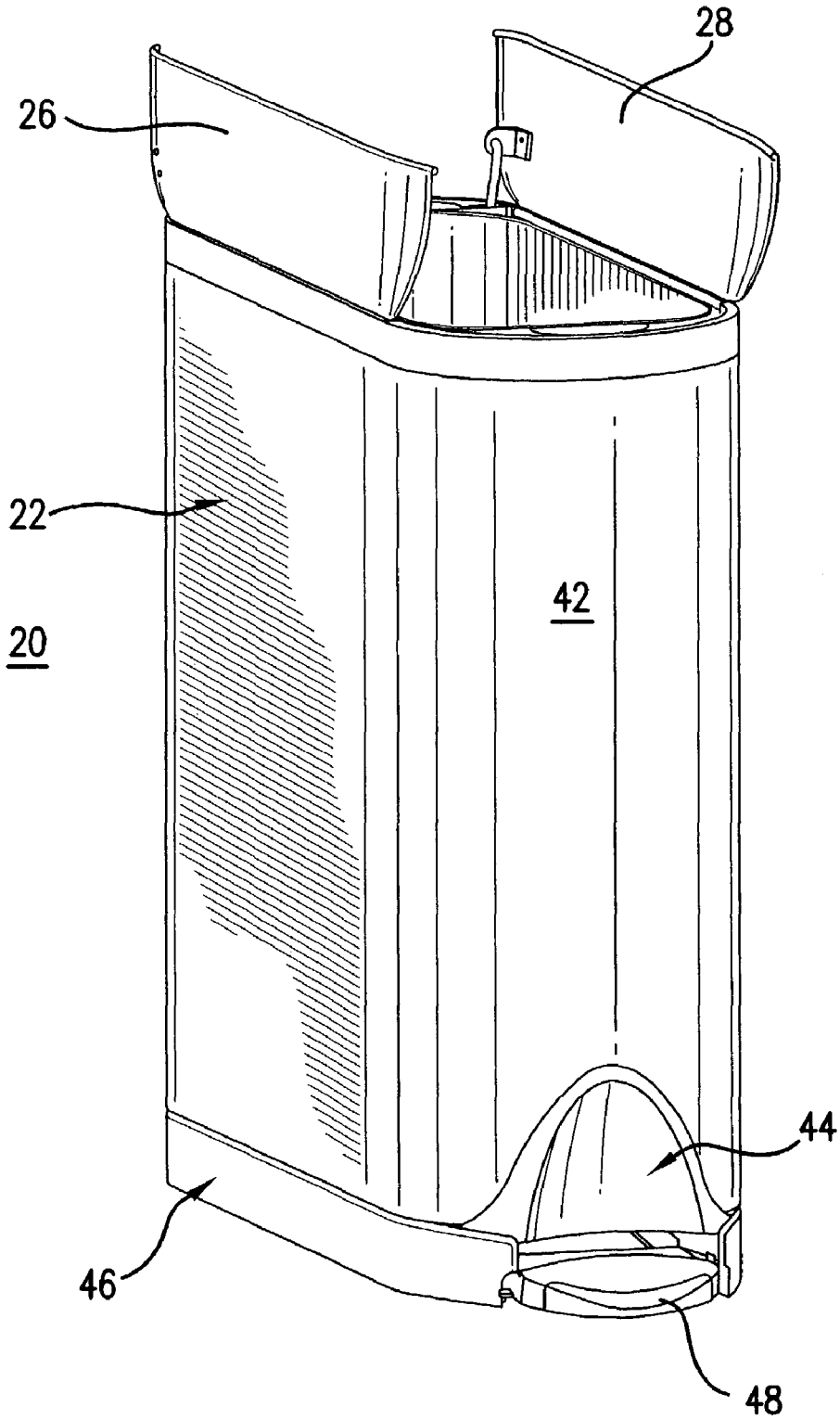
FIG. 1 is a front perspective view of a trash can assembly according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1-9 illustrate one embodiment of a trash can assembly 20 according to the present invention. The assembly 20 has an outer shell 22 and an inner liner 24 that is adapted to be retained inside the outer shell 22.

The outer shell 22 is a four-sided shell that has four side walls, including a front wall 42. It is also possible to provide the outer shell 22 in a generally cylindrical, oval or egg shape. The inner liner 24 can have the same, or different, shape as the outer shell 22. The lid is made up of two separate lid portions 26 and 28 that are split at about the center of the outer shell 22, each of which is hingedly connected to an upper support frame 130 (see FIG. 7) along a top side edge of the outer shell 22 in a manner such that the lid portions 26, 28 pivot away from each other (see arrows M in FIG. 4) when they are opened. The outer shell 22 and its lid portions 26 and 28 can be made of a solid and stable material, such as a metal. The upper support frame 130 can be secured to the opened top of the outer shell 22, and can be provided in a separate material (e.g., plastic) from the outer shell 22. Each lid portion 26, 28 has a side edge 30 that has a sleeve 32 extending along the side edge 30. A shaft (not shown) is retained inside the sleeve 32 and has opposing ends that are secured to one side edge of the upper support frame 130, so that the lid portion 26, 28 can pivot about an axis defined by the shaft and its corresponding sleeve 32. An L-shaped bracket 34 is secured at the rear end of each lid portion 26, 28. One leg of the bracket 34 is secured to the underside of the lid portion 26, 28, and the other leg of the bracket 34 has an opening 40 that is adapted to receive an upper hooked end 36 of a corresponding lifting rod 38.

In addition, a toe-kick recess 44 can be provided on the outer shell 22 adjacent the base 46 of the outer shell 22, and is adapted to receive a foot pedal 48 that is pivotably secured to a pedal bar 60 in the base 46. The toe-kick recess 44 can be formed as part of the base 46, and the outer shell 22 would define a curved cut-out to receive the recess 44. The curved cut-out in the shell 22 can be made by first cutting out a properly sized and configured hole in the body of the outer shell 22, and then inserting a plastic curved panel that defines the actual recess 44. The recess 44 extends into the interior confines of the outer shell 22 (as defined by the periphery of the outer shell 22). The recess 44 also extends upwardly for a short distance from the base 6. The pedal bar 60 is made of a material (e.g., metal) that carries some weight, and extends from the foot pedal 48 along the base 46 and is then pivotably coupled to the lifting rods 38 that extend upwardly along the rear of the outer shell 22 to connect the lid portions 26, 28. The pedal bar 60 and the lifting rods 38 operate to translate an updown pivot motion of the pedal 48 to an up-down pivot motion for the lid portions 26, 28. Each of these components will be described in greater detail hereinbelow.

Figure 3:
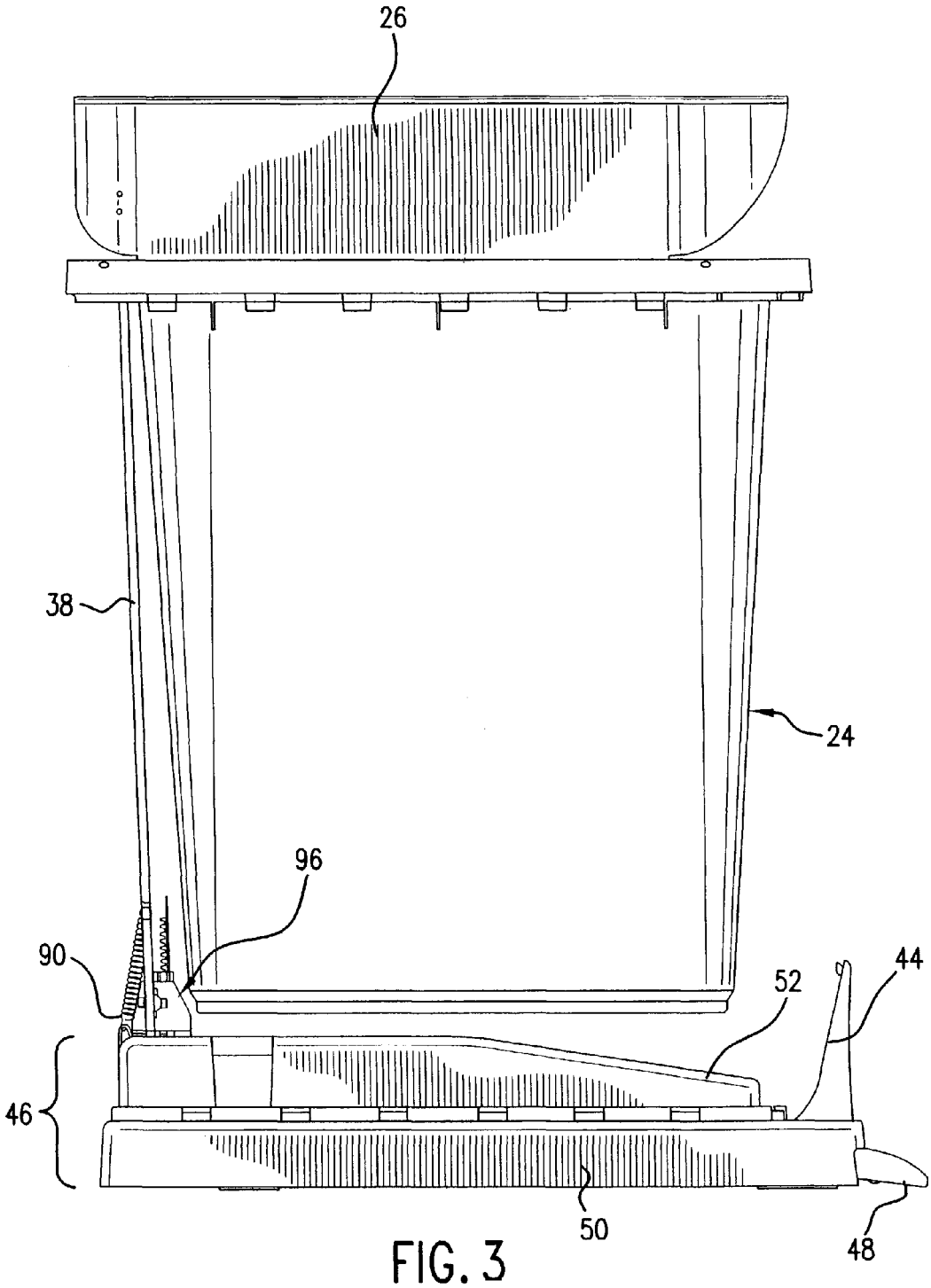
FIG. 3 is a side plan view of the trash can assembly of FIG. 1 shown without the outer shell.
Figure 4:
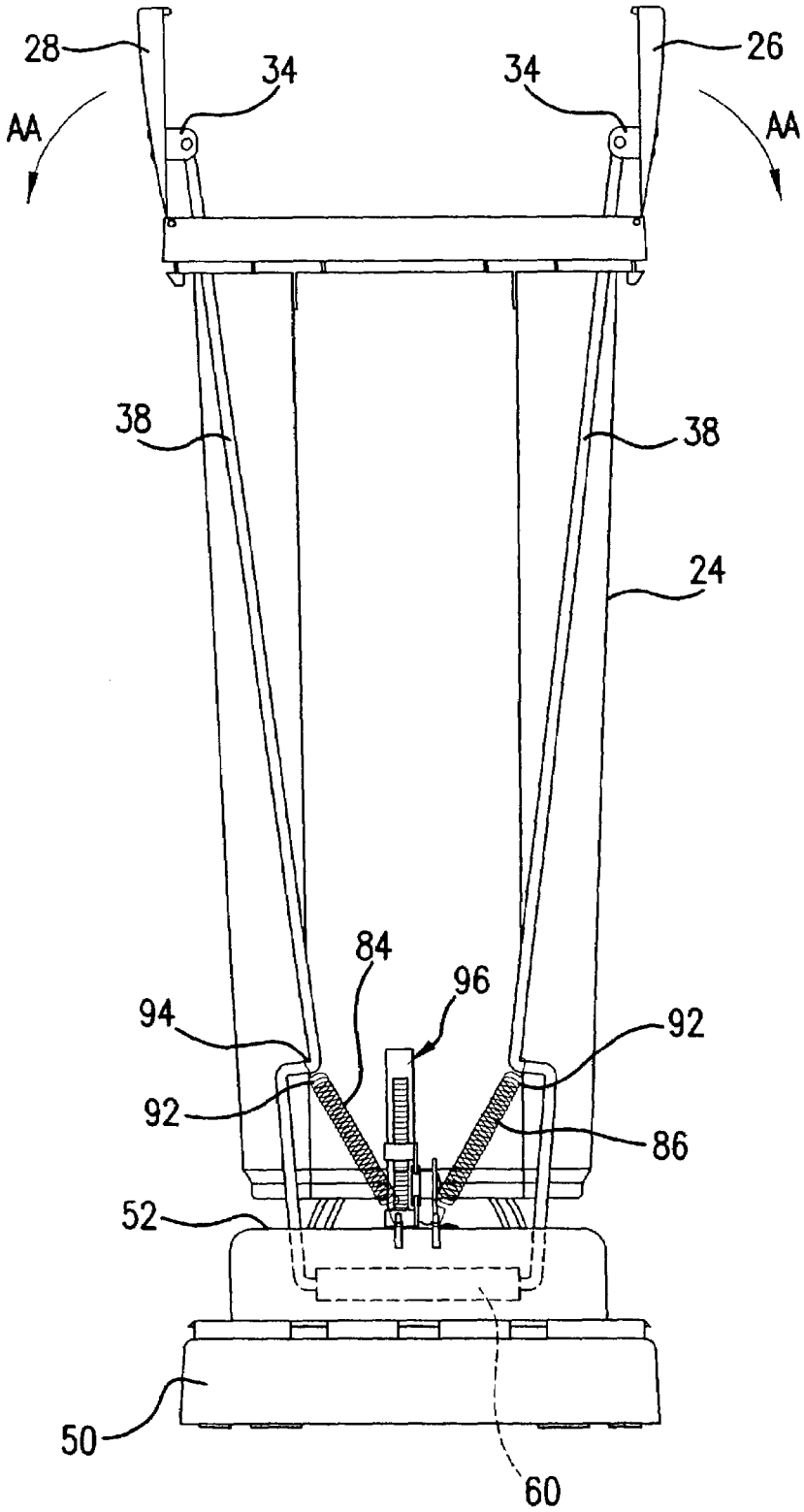
FIG. 4 is a rear view of the trash can assembly of FIG. 1 shown without the outer shell.
Figure 5:
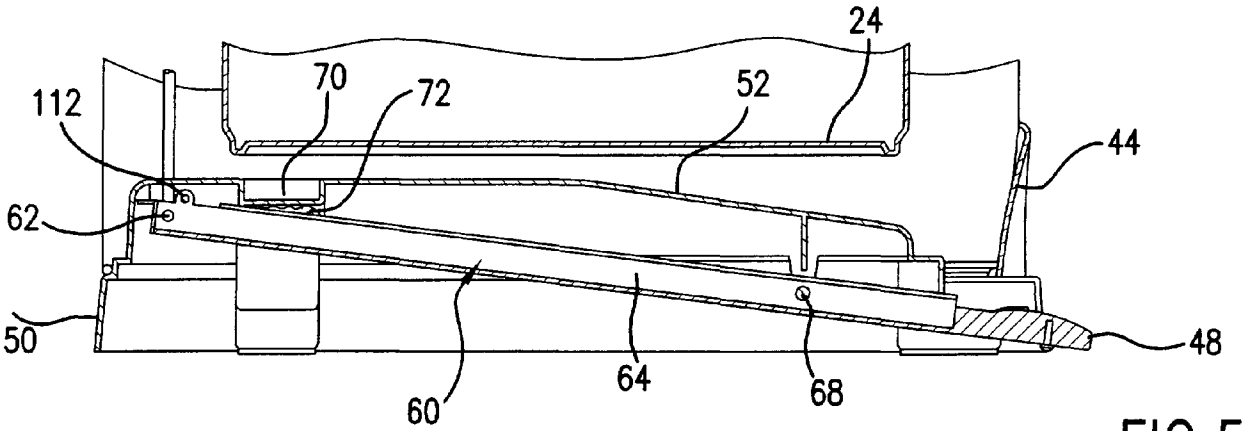
FIG. 5 is an enlarged cross-sectional side view of the base of the trash can assembly of FIG. 1.
Figure 6:
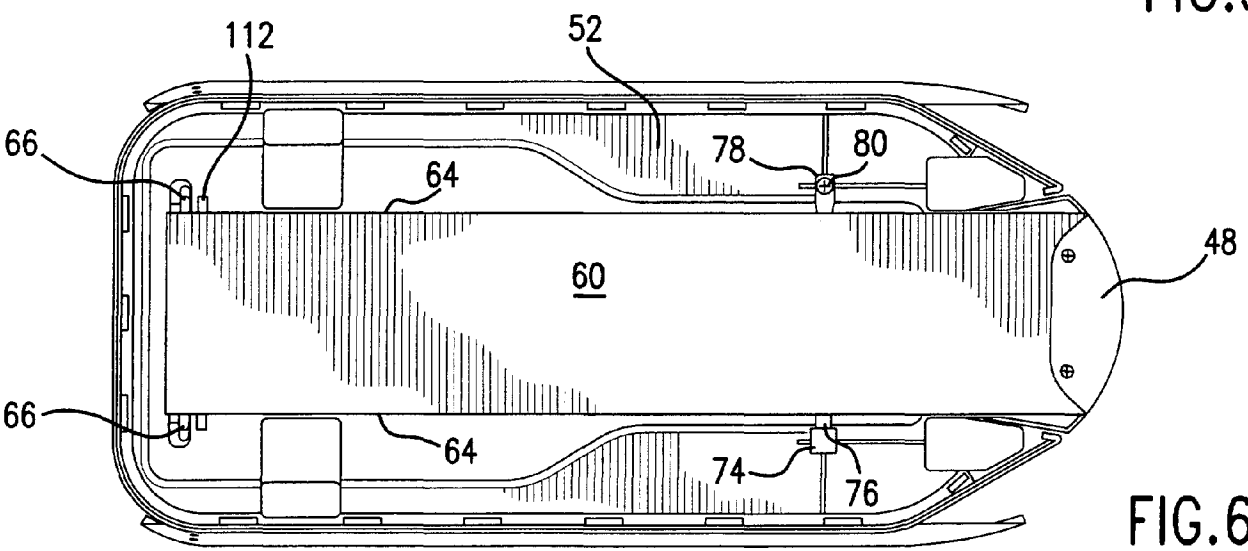
FIG. 6 is a bottom plan view of the trash can assembly of FIG. 1 shown without the outer shell.
Figure 8:
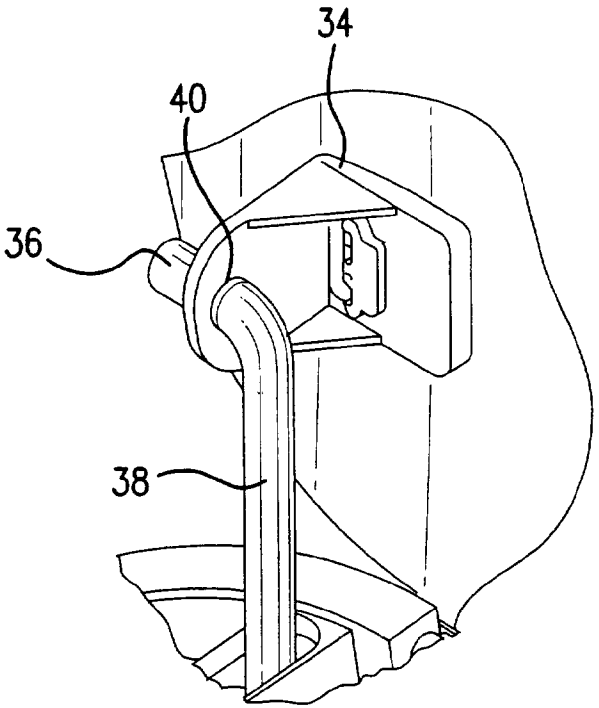
FIG. 8 is an enlarged view of the area labeled X in FIG. 7.

Referring now to FIGS. 3-6, the base 46 of the outer shell 22 has a raised or domed base panel 52 and a skirt or flange portion 50 that extends from the base panel 52. In one embodiment of the present invention, the base panel 52, the skirt 50 and the recess 44 can be formed in one plastic piece. The pedal bar 60 is retained under the base panel 52 and inside the skirt 50. The pedal bar 60 has two short side walls 64. The front of the pedal bar 60 is attached to the pedal 48, and the rear of the pedal bar has two opposite holes 62. One of the holes 62 is provided on each of the two opposing side walls 64, and each hole 62 receives a lower hooked end 66 of a corresponding lifting rod 38. A fulcrum rod 68 extends through the two side walls 64 of the pedal bar 60 at a location that is closer to the front of the pedal bar 60 than the rear of the pedal bar 60. Thus, the pedal bar 60 can be pivoted about a pivot axis defined by he fulcrum rod 68. In particular, the pedal bar 60 can be pivoted between two positions, a first rest position as shown in FIG. 2 where the pedal 48 is at a vertically higher position than the rear of the pedal bar 60, and a second open position (where the lid portions 26, 28 are opened) as shown in FIG. 5 where the pedal 48 is pressed to a vertically lower position than the rear of the pedal bar 60.

Figure 2:
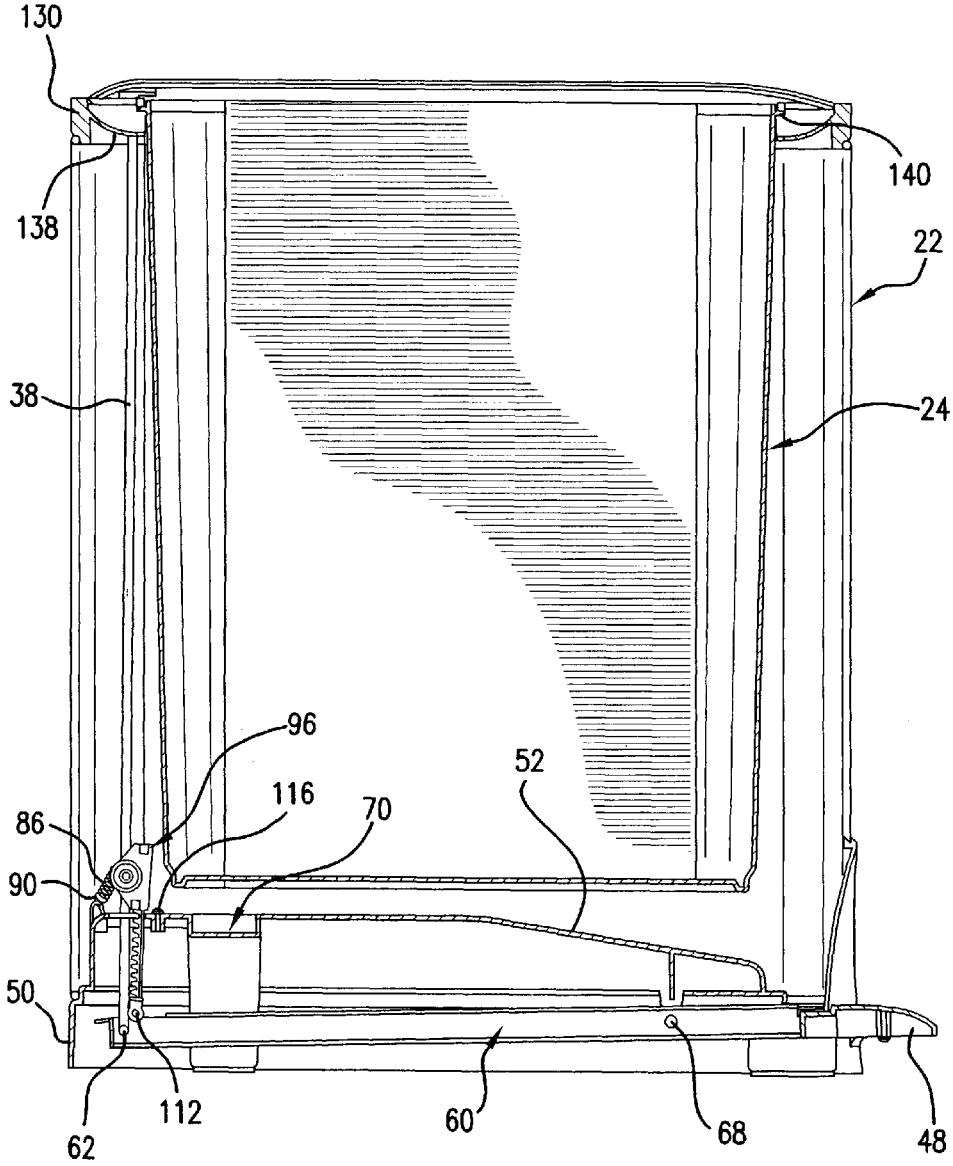
FIG. 2 is a cross-sectional side view of the trash can assembly of FIG. 1.

Thus, the fulcrum rod 68 is positioned at a location that is closer to the front of the pedal bar 60 than the rear of the pedal bar 60 so that the portion of the pedal bar 60 that is rearward of the fulcrum rod 68 would be greater (and therefore heavier) than the portion of the pedal bar 60 that is forward of the pedal bar 60, thereby causing the rear of the pedal bar 60 to be at a vertically lower position than the pedal 48 when in the rest position of FIG. 2.

As shown in FIG. 5, the base panel 52 defines a recessed region 70 with a soft material 72 (e.g., a foam sponge) secured below the recessed region 70. The recessed region 70 acts as a stop member in that it prevents the rear of the pedal bar 60 from being raised to a vertical level that exceeds the vertical position of the recessed region 70, as shown in FIG. 5. The soft material 72 therefore functions as a noise and contact absorber so that there will be minimal noise and wear on the pedal bar 60 when it contacts the recessed region 70.

In many applications, given the dimensions of the base 46, it will be difficult to first position the pedal bar 60 inside the base 46 and then attempt to fit a lengthy fulcrum rod inside the base 46 and insert the fulcrum rod through the pedal bar 60. Therefore, the present invention provides a novel method for securing the fulcrum rod 68 in its desired position with respect to the base 46 and the pedal bar 60. First, referring to FIG. 6, the base panel 52 is provided with a column 74 that extends vertically downwardly from the base panel 52, and the column 74 has a horizontal bore (not shown) that opens towards the center of the base 46. Next, the fulcrum rod 68 is extended through opposing and aligned openings in the two side walls 64 so that the two opposing ends 76, 78 of the fulcrum rod 68 extend beyond the side walls 64. In the next step, the pedal bar 60 and the fulcrum rod 68 are positioned inside the base panel 52, with one end 76 of the fulcrum rod 68 positioned inside the bore of the column 74. The other end 78 of the fulcrum rod 68 has a flat configuration with a hole (not shown), so that a screw 80 can be threaded through the hole in the end 78 to secure the fulcrum rod 68 to the base panel 52.

A pair of springs 84 and 86 are provided to normally bias the lid portions 26, 28 to the closed position shown in FIG.

2. Referring to FIGS. 2-4, each spring 84, 86 has a first end 90 that is secured to the base panel 52, and a second end 92 that is secured to a bent portion 94 of one of the lifting rods 38. Thus, when the assembly 20 is not experiencing any external forces (i.e., it is in the closed position), the springs 84, 86 will normally bias the lifting rods 38 in the downward vertical direction, thereby causing the lid portions 26, 28 to be closed. The springs 84, 86 also prevent the lower hooked ends 66 from becoming disengaged from the rear of the pedal bar 60, and takes out any slack in the linkage involving the lifting rods 38.

The assembly 20 provides a motion damper 96 that functions to dampen the closing motion of the lid portions 26, 28 so that the lid portions 26, 28 can close slowly and not experience a hard slamming motion. The motion damper 96 is illustrated in greater detail in FIG. 9, and can be embodied in the form of the "Rotary Motion Damper" sold by ITW Delpro of Frankfort, Ill., although other known and conventional motion dampers can be utilized without departing from the scope of the present invention. The motion damper 96 has a toothed bar 98 with a row of teeth 100 positioned along a side thereof. One end of the toothed bar 98 has a pair of aligned openings 102. A platform 104 has a pair of guides 106 that receive the toothed bar 98. A toothed damping wheel 108 is carried on the platform 104 and is adapted to engage the teeth 100 on the toothed bar 98 as the platform 104 experiences relative movement in both directions (see arrows A and B) along the toothed bar 98. Assuming that the damping wheel 108 remains stationary, when the toothed bar 98 moves in the direction B, the damping wheel 108 does not offer any resistance so the toothed bar 98 can move smoothly and quickly in the direction B. However, when the toothed bar 98 moves in the direction A, the damping wheel 108 does offer resistance so the toothed bar 98 can only move very slowly in the direction A. The motion damper 96 is positioned in the interior of the outer shell 22, and is secured to both the base panel 52 and the pedal bar 60. In particular, the platform 104 has a connecting element 110 that is secured to a bracket (not shown) in the base panel 52. The bracket can be secured to the base panel 52 by a screw 116 as shown in FIG. 2. In addition, the end of the toothed bar 98 with the aligned openings 102 extends through an opening in the base panel 52, and a damping rod 112 secured to the pedal bar 60 extends through the openings 102 (see FIGS. 5 and 6) to couple the toothed bar 98 to the pedal bar 60. Thus, the platform 104 of the motion damper 96 is essentially fixed at a stationary position with respect to the base panel 52, and the toothed bar 98 can be moved up or down (i.e., in the directions B or A) as the rear end of the pedal bar 60 is pivoted up or down by the pedal 48.

The operation of the trash can assembly 20 will now be described. When the assembly 20 is not in use, the lid portions 26, 28 are normally closed as shown in FIG. 2. At this position, the springs 84 and 86 are relaxed and do not exert any bias. To open the lid portions 26, 28, the user steps on the pedal 48, which pivots the pedal bar 60 about the fulcrum rod 68 with the pedal 48 moving vertically downward, and the rear end of the pedal bar 60 being pivoted vertically upwardly. The soft material 72 provides a buffer or absorber to minimize any noise that may be caused by the pedal bar 60 contacting the recessed region 70. As shown in FIGS. 3-5 and 7-8, the rear end of the pedal bar 60 pushes the lifting rods 38 upwardly, so that the lifting rods 38 will push the lid portions 26, 28 open about the pivoting of the shafts in the sleeves 32. The lid portions 26, 28 will pivot away from each other to expose the top of the of the outer shell 22. Simultaneously, the damping rod 112 will push the toothed bar 98 upwardly (i.e., in the direction B in FIG. 9). As described above, the damping wheel 108 will not offer any resistance to the movement of the toothed bar 98, so the entire lifting motion of the rear of the pedal bar 60 and the lifting rods 38 will be smooth and relatively quick. At this opened position, the springs 84 and 86 are stretched and therefore biased. As long as the user maintains his or her step on the pedal 48, the bias of the springs 84, 86 is overcome, the rear of the pedal bar 60 will remain in the position shown in FIG. 5, and the lid portions 26, 28 will remain opened.

When the user releases the pedal 48, the combined weight of the pedal bar 60 (i.e., a pulling force) and the lid portions 26, 28 (i.e., pushing forces), as well as gravity and the natural bias of the springs 84, 86, will cause the lid portions 26, 28 will pivot downwardly to their closed positions. In other words, the lifting rods 38, the toothed bar 98 and the pedal bar 60 will all experience a downward motion. In this regard, the fact that the fulcrum rod 68 is positioned closer to the pedal 48 (i.e., the front of the pedal bar 60) means that the rear of the pedal bar 60 is actually heavier, and will exert a force to aid in pulling the lifting rods 38 down in a vertical direction. However, the damping wheel 108 will resist the downward vertical movement (i.e., in the direction of arrow A in FIG. 9) of the toothed bar 98, so the entire downward motion of the rear of the pedal bar 60 and the lifting rods 38 will be slowed. By slowing this downward motion of the pedal bar 60 and the lifting rods 38, the lid portions 26, 28 will close slowly, and the pedal bar 60 will be lowered slowly, all to avoid any annoying loud slamming actions or noises.

Figure 7:
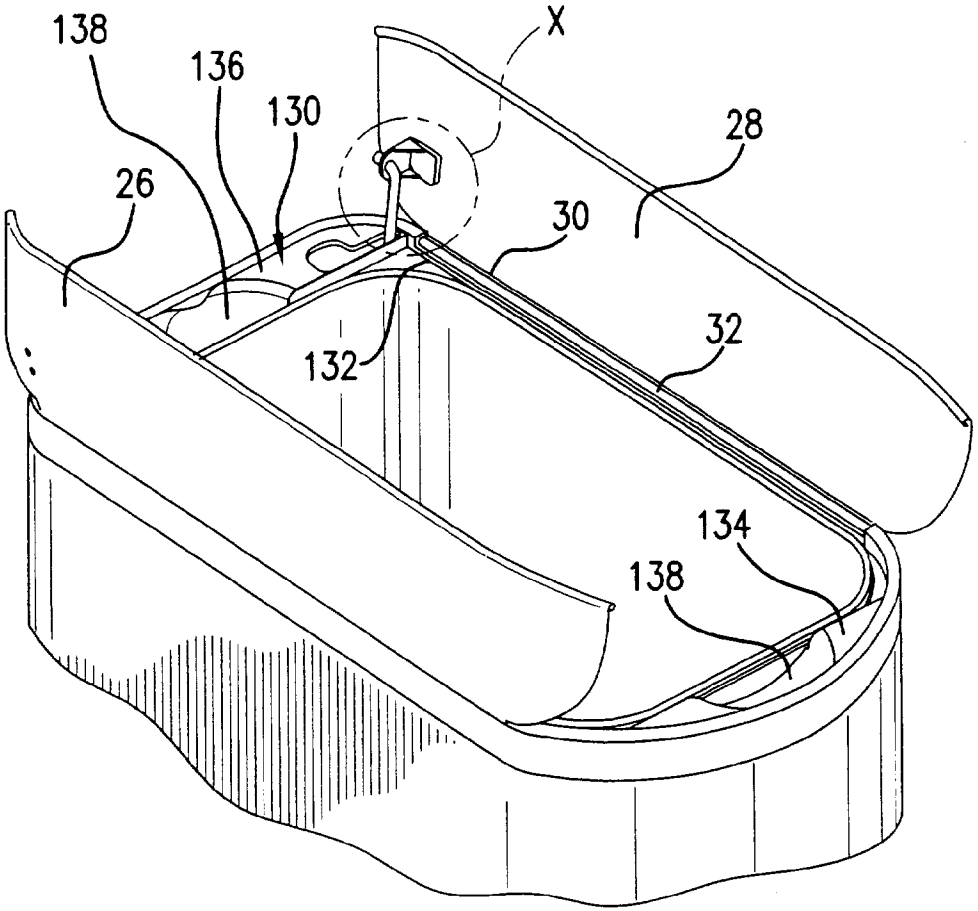
FIG. 7 is an enlarged top perspective view of the upper part of the trash can assembly of FIG. 1.
Figure 9:
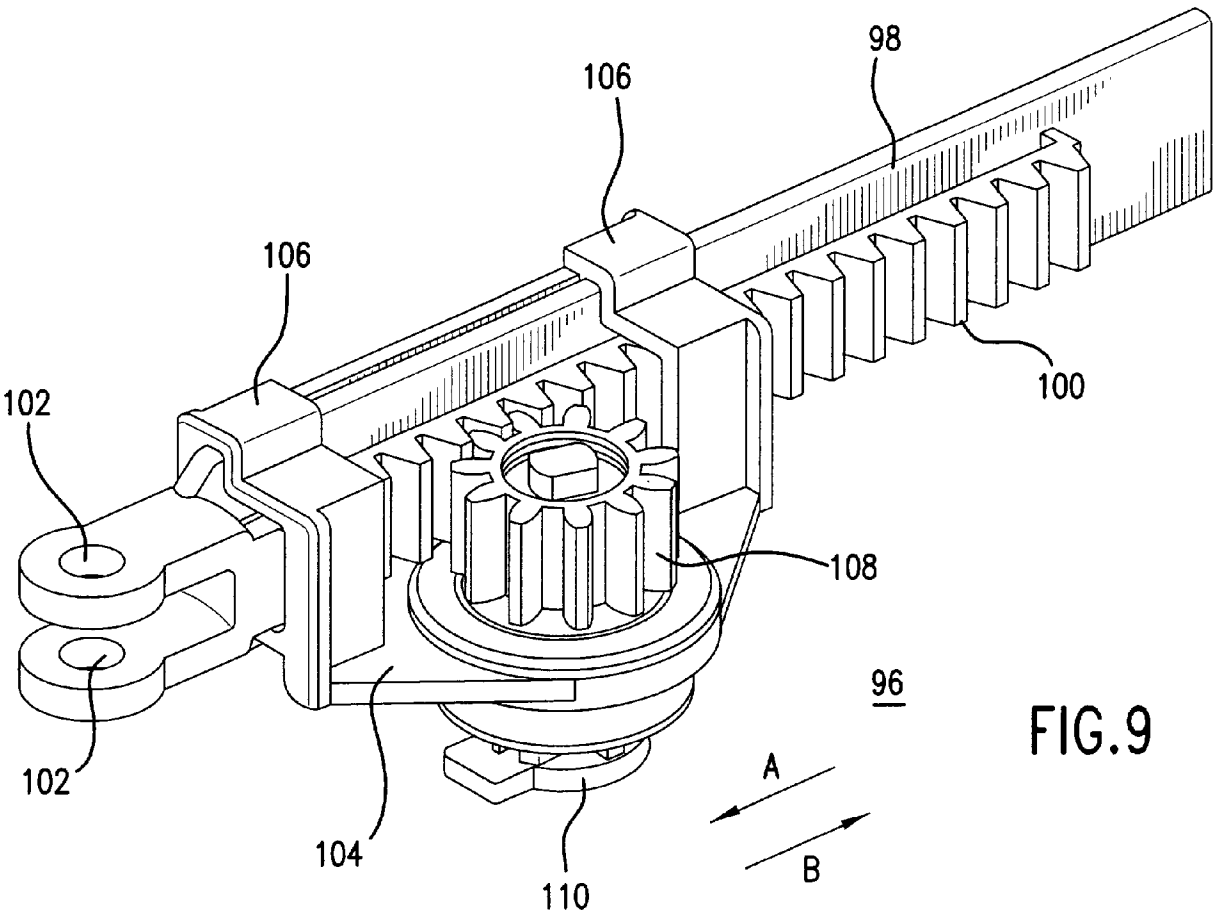
FIG. 9 is an isolated perspective view of a motion damper that can be used with the assembly of FIG. 1.
Figure 13:
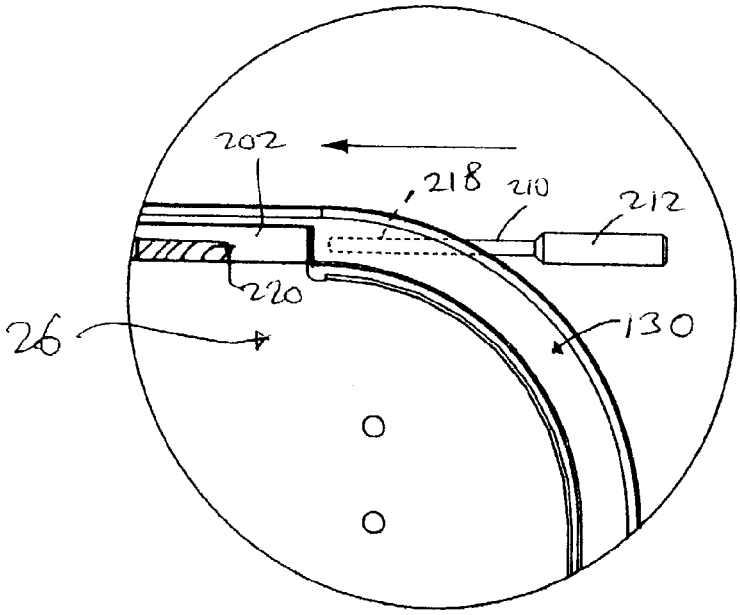
FIG. 13 is an enlarged isolated view of one top corner of the trash can assembly of FIG. 10.
Figure 14:
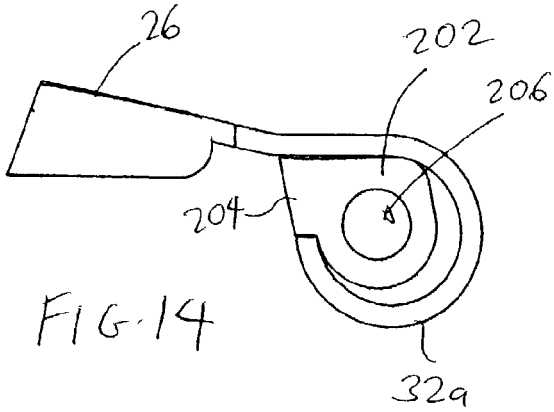
FIG. 14 is a cross-sectional view of the tube and a lid portion of the trash can assembly in FIG. 10.

Referring now to FIGS. 2 and 7, the upper support frame 130 has a border shoulder 132 that extends along its inner periphery which is adapted to receive the upper lip 140 of the inner liner 24 so that the inner liner 24 can be suspended on the shoulder 132 inside the outer shell 22 during use. The support frame 130 has opposing ends 134 and 136, with a scalloped groove 138 formed in each end 134, 136. The scalloped grooves 138 allow the user to insert his or her fingers into the grooves 138 under the upper lip of the inner liner 24 to lift the inner liner 24 from the interior of the outer shell 24 when the lid portions 26, 28 are opened. This provides a convenient way for the user to remove the inner liner 24 from the outer shell 22, without requiring the user to grab or grip unnecessarily large portions of the inner liner 24. The hinged connection of the lid portions 26, 28 to the upper support frame 130 shown in FIG. 7 can be modified as shown in FIGS. 10-14. In FIG. 7, each lid portion 26, 28 has a metal shaft that is retained in a sleeve 32 and has opposing ends that are secured to the upper support frame 130 in a manner such that the corresponding lid portion 26 or 28 can pivot about an axis defined by the shaft and the sleeve 32. The sleeve 32 can be formed by curling part of the edge of the metal lid portion 26, 28 in a manner that leaves a longitudinal opening along the length of the sleeve 32 between the outermost edge of the sleeve 32 and the lid portion 26, 28. This curling is best illustrated in FIG. 14 in connection with the sleeve 32*a*. The metal shaft can be retained inside this sleeve 32. Unfortunately, the metal-on-metal contact between the shaft and the sleeve 32 causes wear and tear, and result in the generation of squeaky noises when the shaft pivots inside the sleeve 32. In addition, after extended use, food, dust and other waste matter may enter the interior of the sleeve 32 via the longitudinal opening, which may impede the pivoting motion of the shaft inside the sleeve 32.

The present invention provides a modified connection in FIGS. 10-14 that overcomes these drawbacks. The same numeral designations will be used to designate the same elements in FIGS. 7 and 10-14, except that an "a" will be added to the designations in FIGS. 10-14. In the embodiment shown in FIGS. 10-14, the metal shaft 200 is retained inside a non-metal (e.g., plastic) tube 202, which is in turn retained inside the sleeve 32*a*, as best shown in FIG. 14. The tube 202 has a generally cylindrical configuration with a protruding edge 204 extending along the length of the tube 202. The protruding edge 204 is configured as a somewhat rectangular block that is adapted to fit snugly into the longitudinal opening of the sleeve 32*a*, thereby blocking the longitudinal opening and preventing dust and particles from entering the interior of the sleeve 32*a*. As best shown in FIG. 14, the tube 202 does not completely fill up the interior space of the sleeve 32*a*.

Figures 11, 12:
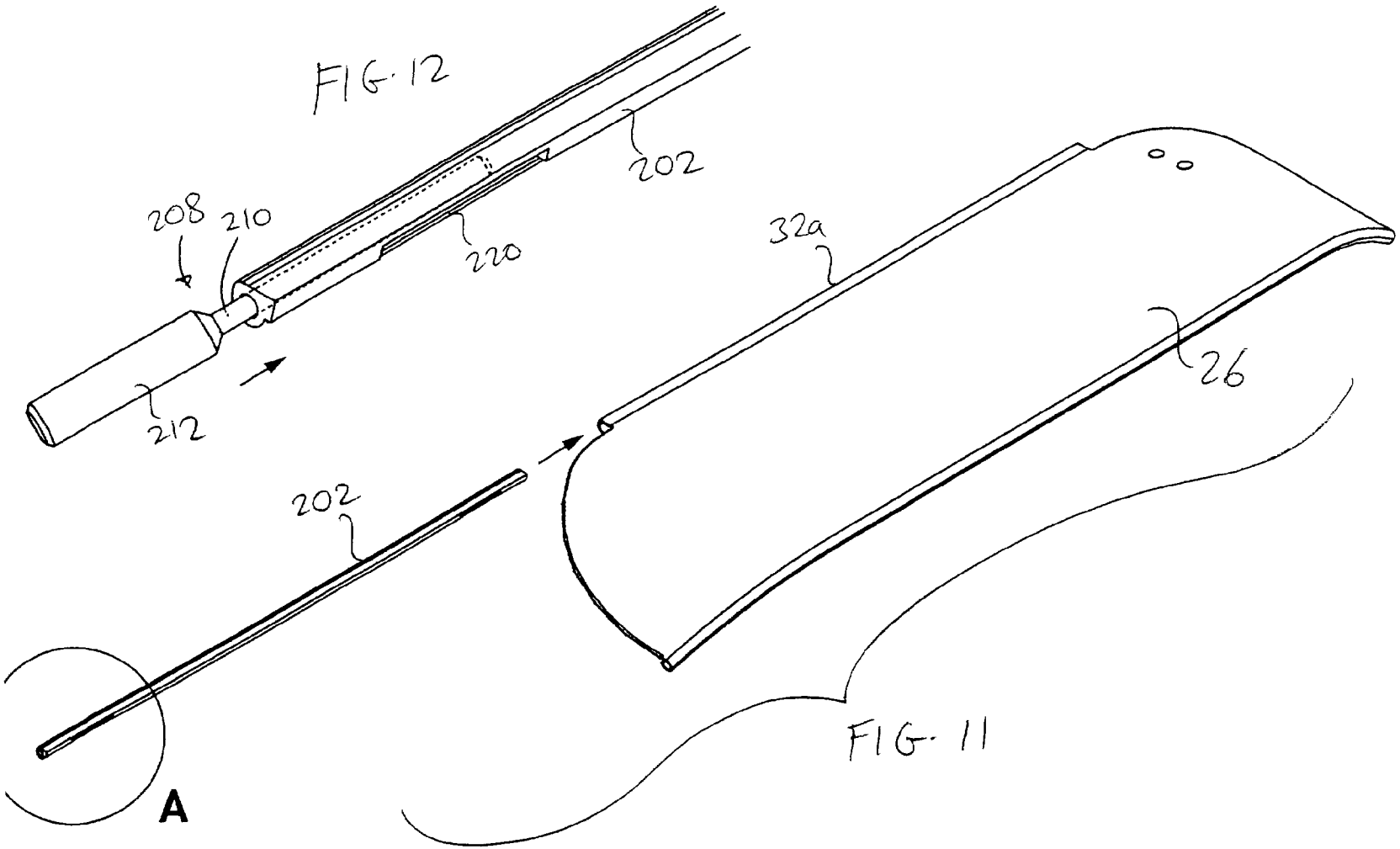
FIG. 11 is an exploded isolated perspective view of one lid portion and tube of the trash can assembly of FIG. 10.
FIG. 12 is an enlarged isolated view of a portion of the tube and shaft piece of the trash can assembly of FIG. 10.

The tube 202 has an interior bore 206 through which two separate shaft pieces 208 can be inserted. Both shaft pieces 208 can be identical in construction, with one provided at each of the opposing ends of the tube 202. The shaft pieces 208 can be made from metal. As best shown in FIG. 12, each shaft piece 208 has a smaller-diameter inner section 210 and a larger-diameter outer section 212. The inner section 210 is inserted into the bore 206 at one end of the tube 202, and the outer section 212 has a larger diameter to ensure that part of the shaft piece 208 remains outside the bore 206.

Figure 10:
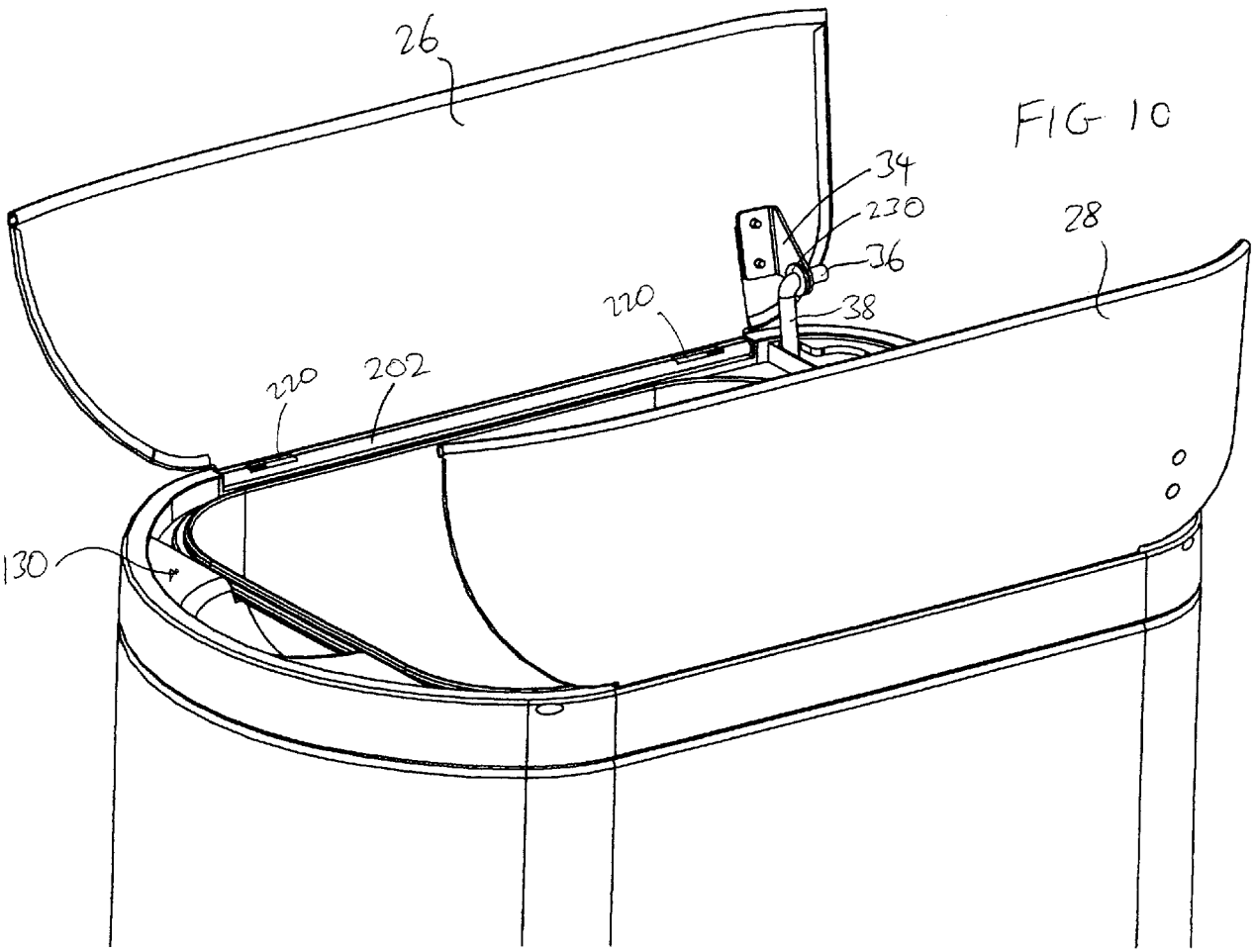
FIG. 10 is an enlarged top perspective view of the upper part of the trash can assembly of FIG. 1 illustrating a modification made thereto.

To assemble the lid portion 26, 28, the user or manufacturer first inserts the tube 202 into the sleeve 32*a* in a manner such that the protruding edge 204 is snugly fitted into the longitudinal opening of the sleeve 32*a*. The sleeve 32*a* and its tube 202 are then placed into the appropriate location on the side edge of the upper support frame 130 as shown in FIG. 10. Then, as shown in FIG. 13, the inner section 210 of each shaft piece 208 is inserted through bores 218 in the upper support frame 130 that are aligned with the bore 206 of the tube 202 when the sleeve 32*a* and its tube 202 are positioned in the upper support frame 130. The inner section 210 will extend through the bore 218 in the upper support frame 130 and then into the bore 206 of the tube 202. A portion of the outer sections 212 of the shaft pieces 212 will be exposed to the outside of the bore 218, but most of the outer sections 212 will be positioned inside the bore 218. With one shaft piece 208 provided at each opposing end of the tube 202 and sleeve 32*a*, the lid portions 26, 28 can pivot about the axis defined by these shaft pieces 208.

A small opening 220 is provided on the protruding edge 204 adjacent each end of the tube 202. The free end of the inner section 210 of each shaft piece 208 is positioned adjacent this opening 220. As a result, a user can remove the lid portions 26, 28 by inserting a sharp-tip object (e.g., screw-driver) through the openings 220 (see FIG. 10) and pushing the inner section 210 of each shaft piece 208 out of the bores 206 and 218.

Thus, the provision of the non-metal tube 202 provides two immediate benefits. First, the protruding edge 204 prevents dust and particles from entering the interior of the sleeve 32*a*. Second, the non-metal material of the tube 202 eliminates the metalon-metal contact or grinding of a pivoting metal shaft within a metal sleeve.

Figure 15:
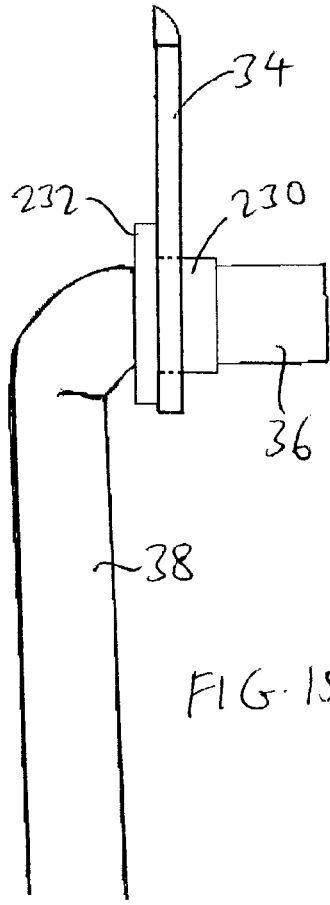
FIG. 15 illustrates the provision of a washer between the bracket and the upper hooked end of the lifting rod.

FIGS. 10 and 15 also illustrate another modification, where a non-metal (e.g., plastic) washer 230 can be provided to prevent the undesirable metal-to-metal grinding between the bracket 34 and the upper hooked end 36 of the lifting rod 38. Specifically, a plastic washer 230 can be positioned in the opening 40 in the bracket 34. The washer 230 can have a sleeved configuration with a flange 232 so that the upper hooked end 36 can extend through the washer 230. As a result, the washer 230 acts as a separating layer between the metal upper hooked end 36 and the metal bracket 34.

Figure 16:
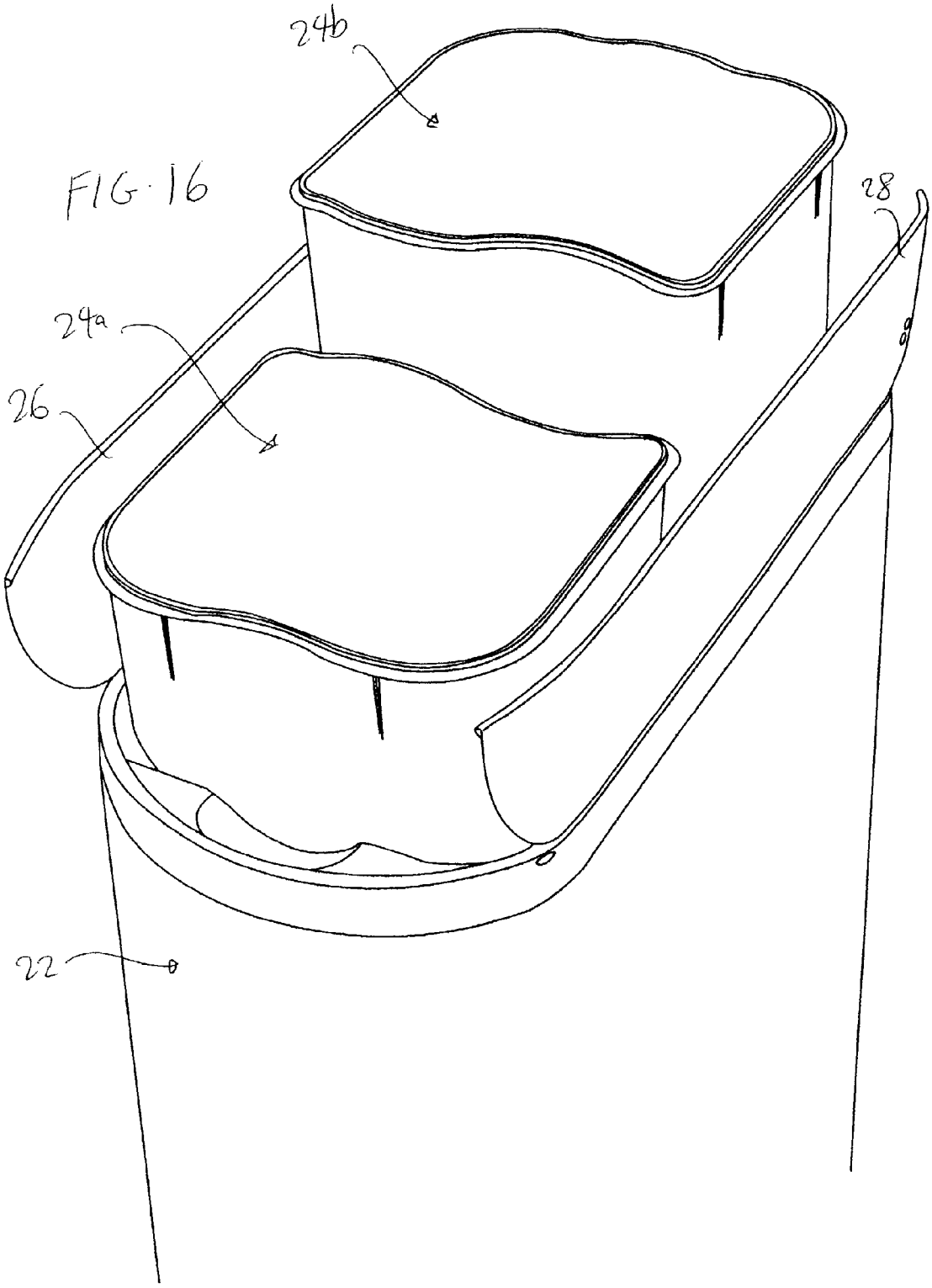
FIG. 16 is a perspective view of the trash can assembly of FIG. 1 showing the provision of two separate inner liners.
Figure 17:
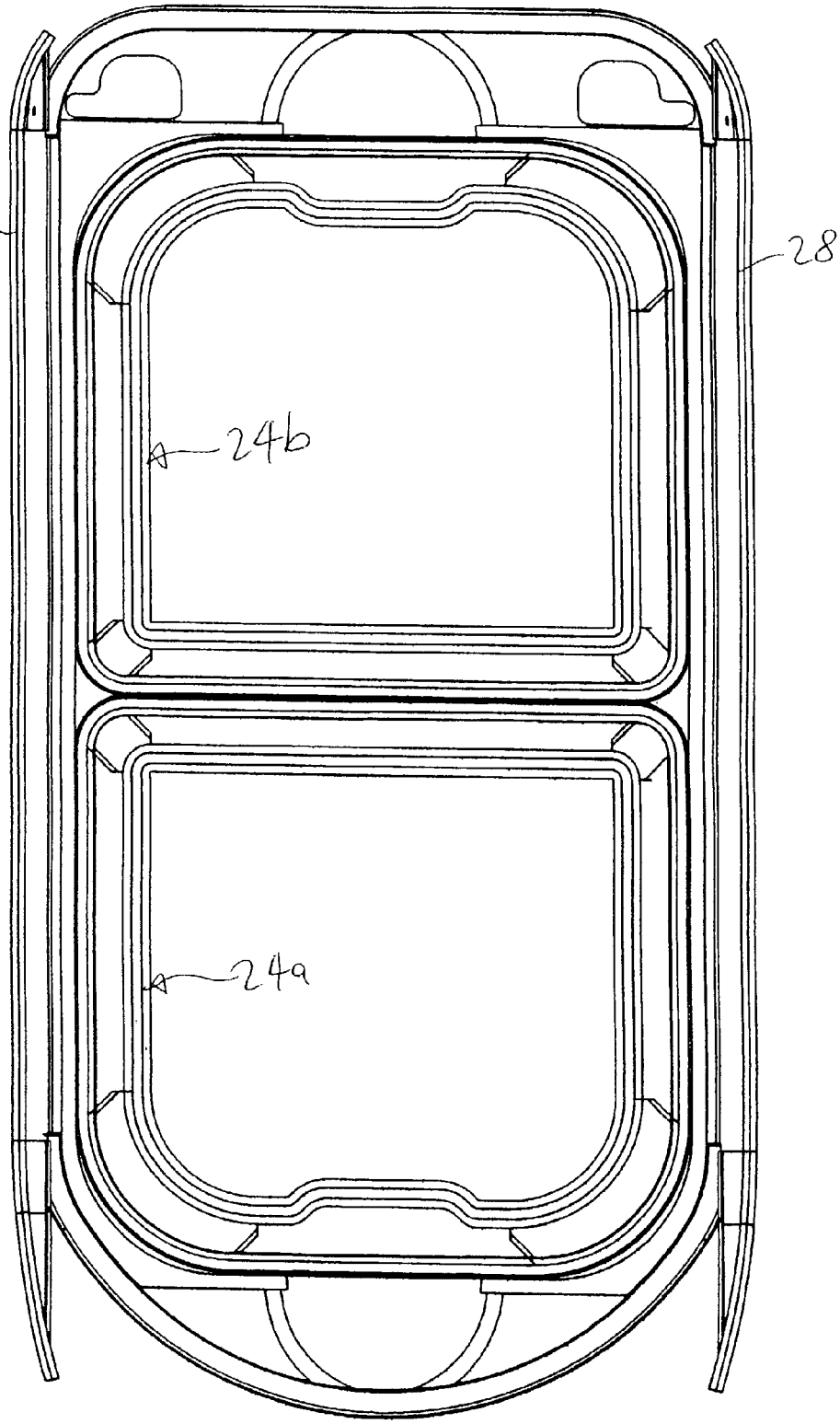
FIG. 17 is a top plan view of the trash can assembly of FIG. 1 showing the provision of two separate inner liners.

FIGS. 1-9 illustrate the use of one inner liner 24, but it is also possible to provide two or more inner liners. For example, FIGS. 16 and 17 illustrate two inner liners 24*a* and 24*b* that can be configured to fit snugly, and in side-by-side fashion, inside the outer shell 22. The provision of two inner liners 24 allows the user to sort the trash, for example, to separate recycleable waste matter from other waste matter.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having four side walls that define a perimeter, the four side walls connected to each other to form an elongated configuration, the four side walls comprising a first side wall, a second side wall, a third side wall and a fourth side wall, with the first and third side walls being opposite and parallel to each other, and with the second and fourth side walls being opposite to each other;

wherein each side wall has a top edge, with the top edges of the side walls defining an open top for the shell;

a frame that is secured to the top edges of the side walls, the frame defining a perimeter;

wherein the first and third side walls are straight, and are longer than the second and fourth side walls;

wherein the fourth side wall is a straight rear wall and the second side wall is curved as it extends from the first side wall to the third side wall;

a first elongated lid portion having a side edge hingedly coupled to the frame at a first hinge connection above the top edge of the first side wall, such that the first elongated lid portion and the first hinge connection are within the perimeter of the frame;

a second elongated lid portion having a side edge hingedly coupled to the frame at a second hinge connection above the top edge of the third side wall, such that the second elongated lid portion and the second hinge connection are within the perimeter of the frame; and wherein the frame has an upper edge that has the same perimeter as the shell.

2. The assembly of claim 1, wherein the frame is made from a different material as the lid portions.

3. The assembly of claim 1, wherein the frame is made of plastic.

4. The assembly of claim 3, wherein the lid portions are made of metal.

5. The assembly of claim 1, wherein the lid portions have inner edges that define a center line for the open top of the shell.

6. The assembly of claim 1, wherein each lid portion has an inner edge, with the inner edges positioned side-by-side when the lid portions cover the open top of the shell.

7. A trash can assembly, comprising:

a shell having four side walls that define a perimeter, the four side walls connected to each other to form an elongated configuration, the four side walls comprising a first side wall, a second side wall, a third side wall and a fourth side wall, with the first and third side walls being opposite and parallel to each other, and with the second and fourth side walls being opposite to each other;

wherein each side wall has a top edge, with the top edges of the side walls defining an open top for the shell;

a frame that is secured to the top edges of the side walls, the frame defining a perimeter, wherein the frame defines a first elongated slot along the top edge of the first side wall within the perimeter of the frame, and a second elongated slot along the top edge of the third side wall within the perimeter of the frame;

wherein the first and third side walls are straight, and are longer than the second and fourth side walls;

a first elongated lid portion having a side edge hingedly coupled to the frame at a first hinge connection above the top edge of the first side wall;

a second elongated lid portion having a side edge hingedly coupled to the frame at a second hinge connection above the top edge of the third side wall; and wherein the frame has an upper edge that has the same perimeter as the shell;

wherein each lid portion has a sleeve provided along its side edge, with the sleeve of the first lid portion received inside the first elongated slot to hingedly couple the first lid portion to the top edge of the first side wall, and the sleeve of the second lid portion received inside the second elongated slot to hingedly couple the second lid portion to the top edge of the third side wall, such that the first hinge connection comprises the first elongated slot and the sleeve of the first lid portion, and the second hinge connection comprises the second elongated slot and the sleeve of the second lid portion.

8. A trash can assembly, comprising:

a shell having a top end, a bottom end and four side walls that are connected to each other to form an elongated configuration, the four side walls comprising a first side wall, a second side wall, a third side wall and a fourth side wall, with the first and third side walls being opposite and parallel to each other, and with the second and fourth side walls being opposite to each other;

wherein each side wall has a top edge, with the top edges of the side walls defining an open top for the shell;

a frame that is secured to the top edges of the side walls, the frame defining a perimeter, wherein the frame defines a first elongated slot along the top edge of the first side wall within the perimeter of the frame, and a second elongated slot along the top edge of the third side wall within the perimeter of the frame;

wherein the first and third side walls are longer than the second and fourth side walls;

a first elongated lid portion having an inner edge, and a side edge hingedly coupled to the frame at a first hinge connection at the top edge of the first side wall;

a second elongated lid portion having an inner edge, and a side edge hingedly coupled to the frame at a second hinge connection at the top edge of the third side wall;

a base attached to the bottom end of the shell;

a toe-kick recess positioned at least partially in the base, the recess having a width that is wide enough to receive a human foot;

wherein the shell and the base are formed of different materials; and a pedal bar positioned at least partially within the base, at least a portion of the pedal bar extending into the toe-kick recess;

wherein each lid portion has a sleeve provided along its side edge, with the sleeve of the first lid portion received inside the first elongated slot to hingedly couple the first lid portion to the top edge of the first side wall, and the sleeve of the second lid portion received inside the second elongated slot to hingedly couple the second lid portion to the top edge of the third side wall, such that the first hinge connection comprises the first elongated slot and the sleeve of the first lid portion, and the second hinge connection comprises the second elongated slot and the sleeve of the second lid portion.

9. The assembly of claim 8, wherein each of the lid portions have approximately the same size and approximately the same dimensions.

10. The assembly of claim 8, further including:

an inner liner positioned substantially within the shell;

wherein a region of minimum thickness of each of the lid portions is substantially less than the minimum distance between the inner liner and the outside surface of the shell.

11. The assembly of claim 8, wherein each of the lid portions are actuated by the pedal bar to move between a substantially closed position in which each of the lid portions is predominantly horizontal, and to an opened position in which each of the lid portions is predominantly vertical.

12. The assembly of claim 8, further including a motion dampening mechanism that decreases the closing speed of the lid portions.

* * * * *